US007955147B1

(12) United States Patent
Legrady et al.

(10) Patent No.: US 7,955,147 B1
(45) Date of Patent: Jun. 7, 2011

(54) SURFACE MOUNT (SMT) CRIMP TERMINAL AND METHOD OF SECURING WIRE TO SAME

(75) Inventors: Janos Legrady, Putnam Valley, NY (US); Raffaele Tarulli, Irvington, NY (US)

(73) Assignee: Zierick Manufacturing Corporation, Mount Kisco, NY (US)

( * ) Notice: Subject to any disclaimer, the term of this patent is extended or adjusted under 35 U.S.C. 154(b) by 0 days.

(21) Appl. No.: 12/723,758

(22) Filed: Mar. 15, 2010

(51) Int. Cl.
*H01R 4/10* (2006.01)

(52) U.S. Cl. ..... 439/877; 439/83

(58) Field of Classification Search ..... 439/877, 439/878, 881, 888, 83
See application file for complete search history.

(56) References Cited

U.S. PATENT DOCUMENTS

| | | | | |
|---|---|---|---|---|
| 2,272,244 | A | 1/1940 | Klein | |
| 2,375,741 | A | 1/1942 | Dibner | |
| 2,396,725 | A * | 3/1946 | Thomas, Jr. | 439/590 |
| 2,526,277 | A * | 10/1950 | Rogoff | 174/87 |
| 2,638,367 | A * | 5/1953 | Bergan | 403/274 |
| 2,799,721 | A * | 7/1957 | Floyd, Jr. | 174/94 R |
| 3,638,305 | A | 2/1972 | Bolttcher | |
| 3,976,385 | A | 8/1976 | Klopfer | |
| 4,829,146 | A * | 5/1989 | Duve | 174/94 R |
| 5,254,022 | A * | 10/1993 | Stuart | 439/877 |
| 5,522,739 | A * | 6/1996 | Axelsson | 439/730 |
| 6,350,145 | B1 | 2/2002 | Chen et al. | |
| 6,442,832 | B1 * | 9/2002 | Noble | 29/854 |
| 6,909,051 | B2 | 6/2005 | Noble | |
| 2005/0230148 | A1 | 10/2005 | Sinnett et al. | |

* cited by examiner

*Primary Examiner* — Hae Moon Hyeon
(74) *Attorney, Agent, or Firm* — Lackenbach Siegel LLP; Myron Greenspan

(57) ABSTRACT

An surface mount technology ("SMT") crimp terminal for mounting on printed circuit boards is in the form of a seamless circular tube or cylinder. The method of use includes depositing the SMT crimp terminal on a copper pad or land on a printed circuit board ("PCB") coated with solder paste to render the pad or land tacky. The solder is reflowed by application of heat and the crimp terminal is soldered to the PCB. A bare wire to be retained is inserted through one end of the tube and the tube is subjected to sufficiently high stress, intermediate its axial ends, to induce plastic flow on the surface of the material. The force plastically deforms the central region of the tube as well as the bare wire received therein. Any form of mechanical hydraulic press can be used for this purpose and resulting deformation of the crimp terminal and the wire contained therein provides a retention force on the wire which is greater than wire breaking strength.

11 Claims, 2 Drawing Sheets

SURFACE MOUNT (SMT) CRIMP TERMINAL AND METHOD OF SECURING WIRE TO SAME

BACKGROUND OF THE INVENTION

1. Field of the Invention

The present invention generally relates to electrical contacts and, more specifically, to a crimp terminal for surface mounting on a printed circuit board and method of securing wire to same.

2. Description of the Prior Art

Deformable electrical contacts have been well known. For example, in U.S. Pat. No. 2,272,244 to Klein teaches that sleeves for connection to a wire by crimping have been known at least as early as 1942. This patent discloses a use of a compression sleeve, an internal stop being provided to arrest the wire beyond a certain point and then the sleeve is crimped, such as by means of a crimping tool. This sleeve is not designed for surface mounting. A similar sleeve is disclosed in U.S. Pat. No. 2,375,741 to Dibner, which is additionally provided with ribs or textured inner surfaces.

A further device for splicing lines is disclosed in U.S. Pat. No. 3,976,385 to Klopfer. Here, the sleeve is provided with a series of axially displaced apertures so that the wire has room to expand by flow of material, and become deformed evidently with the intention of increasing the retention forces on the wire.

A method of creating a seal on a wire in a metal tube is disclosed in U.S. Pat. No. 3,638,305 to Bolttcher, the tube being mounted on a printed circuit board by a through hole.

U.S. Pat. No. 6,350,145 to Chen et al. discloses a flexible crimp terminal. However, this terminal is an open terminal FIG. 4 illustrates the manner in which this terminal crimps wire.

U.S. Pat. No. 6,909,051 to Noble teaches a coupling or terminal contact for attaching a transmission line to a circuit board. However, this terminal has a split upper side and is provided with a jacket or other similar material that is preferably color coded for ready identification. Once the end of the wire is inserted into the terminal it can be crimped such as by a use of a punch. Opposing pincers are used that can access the terminal both from the top as well as through an aperture in the circuit board adjacent to the central region of the tube portion. Evidently, this arrangement is required to provide the desired deformation while avoiding damage to the integrity of the attachment leads soldered to the circuit board. Because leads are used and inclined downwardly, the coupling is elevated above the circuit board and the lower pincer is required to allow pressure to be applied to the contact without forcing the connector downwardly, as this might damage the soldered connections at both axial ends of the device between the leads and printed circuit board ("PCB"). Thus, while the leads are soldered to the PCB, the body of the connector is not but is elevated above the top surface of the PCB.

Another device is illustrated in U.S. Published Patent Application No. 2005/0230148 dated on Oct. 20, 2005 to Sinnett et al. This publication discloses a lead connected to a printed circuit board by physically compressing or pinching the lead between the crimping surfaces the terminal being filled with a material that serves as a distributor of mechanical forces. It is not clear how the terminal is attached to the printed circuit board, the patent simply suggesting that the component is connected to the board.

SUMMARY OF THE INVENTION

It is an object of the invention to provide a surface mount crimp terminal that does not have disadvantages inherent in the previously know electrical connectors.

It is another object of the invention to provide a crimp terminal that is simple in construction and economical to manufacture.

It is still another object of the invention to provide a crimp terminal as in the previous objects that can be conveniently and efficiently mounted on the surface of a printed circuit board.

It is yet another object of the invention to provide a crimp terminal that allows bare wire to be easily and conveniently inserted into the crimp terminal.

It is a further object of the invention to provide a crimp terminal of the type of a discussion that has a seamless cylindrical configuration when placed on a printed circuit board and crimped after the solder is reflowed.

It is still another object of the invention to provide a crimp terminal suitable for surface mounting that provides retention forces on a captured wire that is greater than the breaking strength of the wire.

It is a further object of the invention to provide a crimp terminal as suggested in the previous objects that can be sized to accommodate different diameter wires and wire materials.

It is still further object of the invention to provide a method of reliably and simply securing a bare wire to a seamless crimp terminal surface mounted on a printed circuit board.

In order to achieve above objects, as well as others that become evident, an surface mount technology ("SMT") crimp terminal suitable for mounting on printed circuit boards is in the form of a seamless circular tube or cylinder. The method of use includes depositing the SMT crimp terminal on a copper pad or land on a printed circuit board (PCB) coated with a paste to render the pad or land tacky. The solder is reflowed by application of heat and the crimp terminal is soldered to the PCB. A bare wire to be retained is inserted through one end of the tube and the tube is subjected to sufficiently high stress, intermediate its axial ends, to induce plastic flow on the surface of the material. The force plastically deforms the central region of the tube as well as the bare wire received therein. Any form of mechanical hydraulic press can be used for this purpose and resulting deformation of the crimp terminal and the wire contained therein provides a retention force on the wire which is greater than wire breaking strength.

BRIEF DESCRIPTION OF THE DRAWINGS

Those skilled in the art will also appreciate the improvements and advantages that derive from the present invention upon reading the following detailed description, claims, and drawings in which:

DESCRIPTION OF THE PREFERRED EMBODIMENTS

Figure 1:
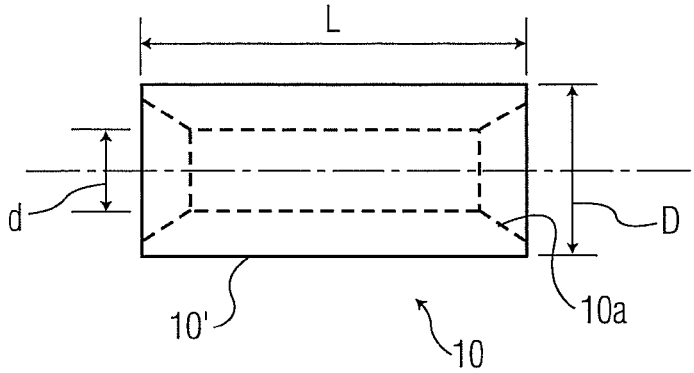
FIG. 1 is a side elevational view of a surface mount ("SMT") crimp terminal in accordance with the present invention, prior to attachment to a printed circuit board ("PCB") and prior to being crimped.
Figure 2:
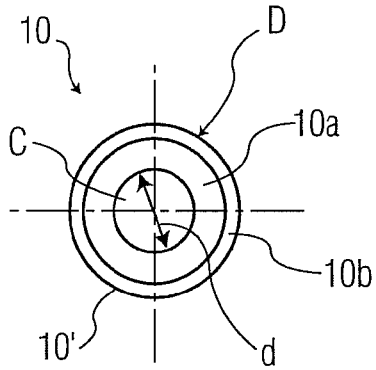
FIG. 2 is an end elevational view of the crimp terminal shown in FIG. 1.
Figure 3:
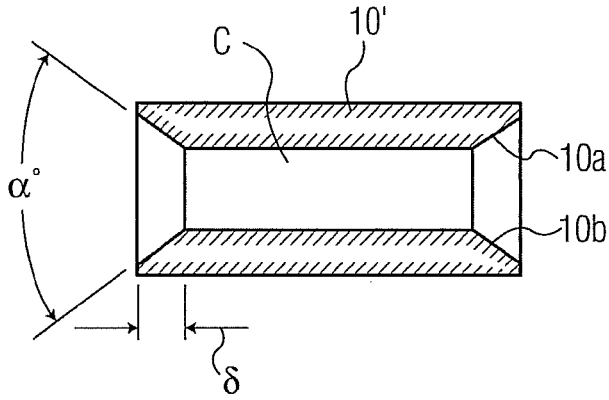
FIG. 3 is longitudinal cross-sectional view of the crimp terminal shown in FIG. 1 taken along a diametrical plane of symmetry.

Referring now to the Figures in which identical or similar parts are designated by the same reference numerals throughout, and first referring to FIGS. 1-3, a crimp terminal electrical contact is generally designated by the reference numeral 10.

The crimp terminal 10 is initially formed as a seamless cylindrical tube 10' having a substantially uniform circular cross section having a larger outer diameter "D" and an internal channel "C" with a smaller inner diameter "d". In accordance with a feature of the invention, the two axial ends of the crimp tube 10 are provided with a countersink, chamfer or bevel 10*a* for facilitating the insertion of a bare wire 12 from either axial end. In one configuration of the crimp tube in accordance with the present invention, the length "L" is 0.140 inches and the outer diameter "D" is 0.063 inches while the inner diameter "d" is 0.028 inches for receiving steel wire having outer diameter of 0.022 inches. The countersink 10*a* leaves a flat annular surface 10*b* and defines an angle $\alpha$ of approximately 70° and the countersinks extend axially inwardly a distance $\delta$ approximately 0.017 inches. The bevels or chamfers 10*a* are intended to facilitate quick insertion of the wire 12 into the channel C of the tube 10 and facilitate assembly.

With an inner diameter "d" of approximately 0.028 inches the wire 12 needs to have an outer diameter slightly less than 0.028 inches. It is preferable that the clearance gap or decrement $\Delta$ between the outside surface or diameter of the wire 12 and the internal surface or diameter "d" of the channel C within the crimp tube be on the order of 0.005 inches, and may be within the range 0.0001-0.010 inches, to allow easy insertion while at the same time providing a maximum tube fill factor and maximum deformation and retention from the crimping of the wire.

Figure 4:
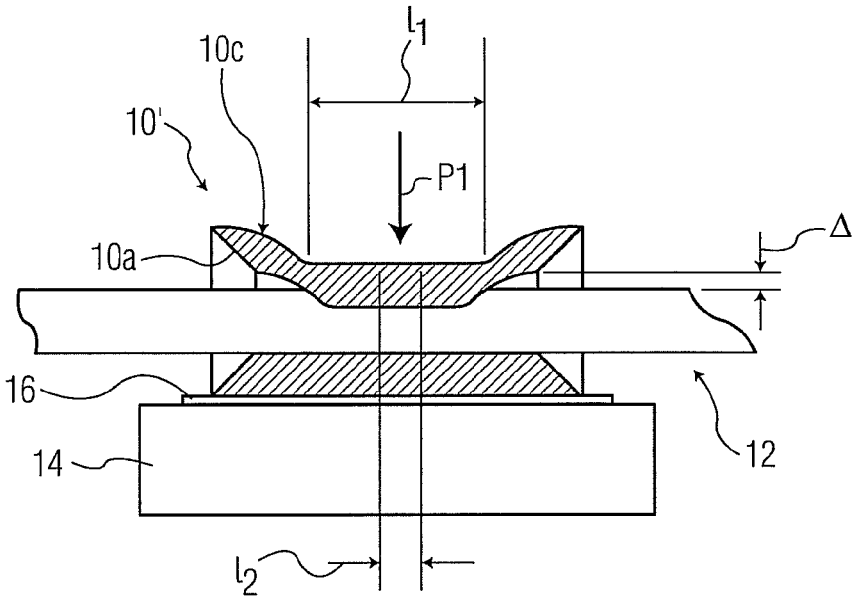
FIG. 4 is a longitudinal section similar to FIG. 3 after the crimp terminal has been surface mounted on a printed circuit board and deformed or coined by stamping with the bare wire within the tube.
Figure 5:
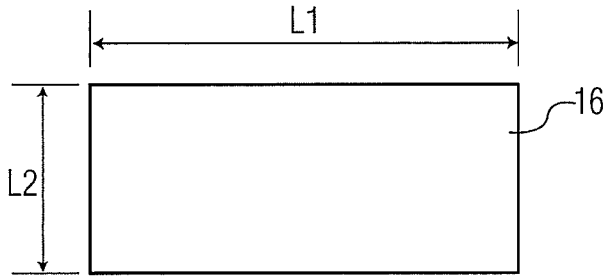
FIG. 5 is a top plane view of a PCB pad or land of the type suitable for mounting the crimp terminal shown in FIGS. 1-4.

Referring to FIGS. 4 and 5, the crimp tube 10 is surface mounted on a printed circuit board (PCB) 14 on which a suitable conventional copper pad or land 16 is provided. With the suggested dimensions of the above mentioned crimp terminal, a copper pad or land suitable for use with the crimp tube may have a length "L1" equal to 0.160 inches and a width "L2" equal to approximately 0.07 inches. The crimp tube 10 is made of a solderable material or coated on its exterior surface with a solderable material, such as brass, that can be readily soldered to land or pad 14.

In use, the method of securing a wire 12 to the PCB 14 includes depositing the crimp tube 10 on the land or pad 14 to which solder paste has been pre-applied. The tackiness of the solder paste initially retains the crimp tube 10 in place. The printed circuit board is then heated and the solder paste is reflowed, essentially centering the crimp tube at the center of the land or pad 16. Once the solder has hardened the wire 12 can be inserted into the tube, as shown in FIG. 4 and the tube crimped. In FIG. 4, larger coined axial length $l_1$ and a shorter coined axial length $l_2$ are illustrated to indicate the ranges of permissible axial crimping lengths. However, for a tube with dimensions described, a crimping axial length of 0.030-0.040 inch can be used effectively. It has been determined that the crimp tube can be used with almost any fiberglass RF4 PCB, although the risk of cracking a board would increase for ceramic-type boards.

While a steel wire with a copper cladding is contemplated for use with the crimp tube or terminal disclosed any wire can be used ranging in diameters from a few thousands of an inch to heavier gauge wires, up to 10 AWG gauge wire that has an outer diameter of 0.1019 inches.

Figure 6:
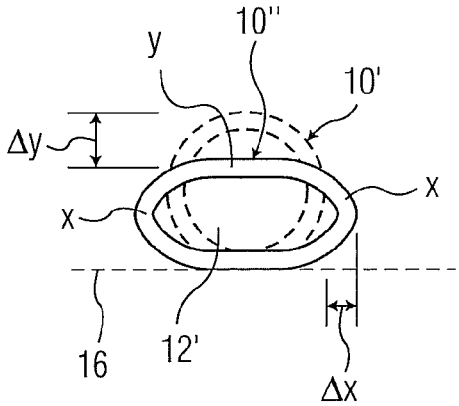
FIG. 6 is a cross-sectional view of the crimp terminal and the bare wire contained therein taken along the central region of the tube shown in FIG. 4 where the tube has been crimped.

Referring to FIGS. 4 and 6, a cross-sectional view is shown through the crimped tube mid-portion 10", illustrating that both tube 10 and the wire 12 inside the tube are essentially flattened by application of pressure P1 applied by any suitable tool to produce a generally oval shaped cross section 12' having a width enlarged by $2\Delta x$ and a height reduced by $\Delta y$ relative to the initial diameter D. However, the remainder of the tube, at both axial ends, remains essentially circular. The combination of the high pressure P1 on the wire portion 12' as well as its deformation relative to the axial ends of the tube, which remain circular, effectively produce extremely high retention forces against separation of the wire by pulling the wire along the axial direction. The retention forces can be in excess of 200 lbs (approximately 890 Newtons), in fact so high that the wire 12 will reach its breaking strength before the wire is released or separated from the crimp tube against the tube retention forces.

The crimp terminal in accordance with the invention, therefore, provides an extremely inexpensive and effective method of securing a wire to a printed circuit board, in a surface mount technology environment, by the use of a simple and single stamping member or element that applies sufficiently high crimping forces to the tube to induce plastic flow on the surface of the materials.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A surface mount crimp terminal comprising an electrically conductive seamless surface mounting cylindrical crimp tube having an exterior surface for soldering to a land or pad of a printed circuit board (PCB) and defining an axis and an internal longitudinal channel forming openings at both axial ends of said crimp tube, said internal channel having a diameter "d" dimensioned to receive a bare wire having a diameter equal to $d-\Delta$, where $\Delta$ is a decrement in the diameter of the bare wire from said diameter "d" that is within the range of 0.0001-0.010 inches.

2. The surface mount crimp terminal as defined in claim 1, wherein said crimp tube and exterior surface are formed of brass.

3. The surface mount crimp terminal as defined in claim 1, wherein said crimp tube is to be crimped along a predetermined axial length and said crimp tube has an axial length greater than said predetermined length.

4. The surface mount crimp terminal as defined in claim 1, wherein said crimp tube has an outer diameter approximately equal to twice said diameter "d".

5. The surface mount crimp terminal as defined in claim 1, wherein said crimp tube develops a retention force in excess of 100 pounds force when crimped along an axial length in excess of 0.030 inches.

6. The surface mount crimp terminal as defined in claim 5, wherein said retention force is in excess of 200 pounds force.

7. A surface mount crimp terminal comprising an electrically conductive seamless surface mounting cylindrical crimp tube having an exterior surface for soldering to a land or pad of a printed circuit board (PCB) and defining an axis and an internal longitudinal channel forming opening at both axial ends of said crimp tube, said internal channel having a diameter "d", at least one axial end being provided with an internal countersink or chamfer to facilitate insertion of a bare wire into said internal channel for wire diameters approaching "d".

8. The surface mount crimp terminal as defined in claim 7, wherein said internal countersink or chamfer is provided at each axial end.

9. The surface mount crimp terminal as defined in claim 7, wherein an angle $\alpha$ defined by said chamfer is selected to be within the range of 40°-100°.

10. The surface mount crimp terminal as defined in claim 9, wherein $\alpha$ is 70°.

11. A method of securing a wire to a printed circuit board (PCB) pad or land comprising the steps of:

applying a tacky solder paste on a pad or land on the PCB;

positioning a seamless cylindrical crimp tube, defining an axis and an internal longitudinal channel forming openings at both axial ends of said crimp tube and an internal diameter "d", on the pad or land with the axis of said crimp tube parallel to said pad or land to contact said tacky paste;

heating said PCB and said crimp tube to reflow the solder to solder said crimp tube to said PCB;

inserting a bare wire within a channel extending through said crimp tube to extend the wire throughout the axial length of said channel; and applying a compression force on said crimp tube in a direction substantially normal to said PCB to crimp said tube within a central region between said axial ends of said crimp tube.

* * * * *